US007515854B2

(12) United States Patent
Kawai

(10) Patent No.: US 7,515,854 B2
(45) Date of Patent: Apr. 7, 2009

(54) IMAGE FORMING APPARATUS

(75) Inventor: Hideaki Kawai, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 254 days.

(21) Appl. No.: 11/691,612

(22) Filed: Mar. 27, 2007

(65) Prior Publication Data

US 2007/0237551 A1 Oct. 11, 2007

(30) Foreign Application Priority Data

Apr. 11, 2006 (JP) ..... 2006-108170

(51) Int. Cl.
*G03G 15/08* (2006.01)

(52) U.S. Cl. ..... 399/258; 399/260

(58) Field of Classification Search ..... 399/119, 399/120, 252, 258, 260, 262
See application file for complete search history.

(56) References Cited

U.S. PATENT DOCUMENTS 5,614,996 A 3/1997 Tanda
5,842,093 A 11/1998 Tanda
5,848,338 A * 12/1998 Okada ..... 399/262
5,848,342 A 12/1998 Tanda
6,131,008 A * 10/2000 Kanamori et al. ..... 399/263
6,292,644 B1 * 9/2001 Goto et al. ..... 399/262
7,428,393 B2 * 9/2008 Hosokawa et al. ..... 399/103

FOREIGN PATENT DOCUMENTS

JP 08-062979 A 3/1996
JP 2000-029309 A 1/2000

* cited by examiner

*Primary Examiner*—Hoan H Tran
(74) *Attorney, Agent, or Firm*—Keating & Bennett, LLP

(57) ABSTRACT

In an image forming apparatus, a second shutter is caused to slide in conjunction with a first shutter which slides in the mounting direction in association with a mounting operation of a developing device to an apparatus body. Accordingly, in association with a separating movement of the developing device from the apparatus body, the first shutter is caused to slide in association with the second shutter which slides in the separating direction, which is the opposite direction from the mounting direction. The direction that the second shutter opens a discharge port is the same direction as the mounting direction. An urging force that a first urging member applies to the first shutter which closes an inlet port is smaller than an urging force that the second urging member is applied to the second shutter which closes the discharge port.

5 Claims, 6 Drawing Sheets

IMAGE FORMING APPARATUS

BACKGROUND OF THE INVENTION

1. Field of the Invention

The present invention relates to an image forming apparatus used for copying machines, printers, facsimiles and so on. More specifically, the present invention relates to an image forming apparatus in which a developing device which is replenished with toner from a replenishing device is removably mounted to an apparatus body.

2. Description of the Related Art

An image forming apparatus is used for copying machines, printers, facsimiles, and multi-function machines having at least two of these functions. The uniformly charged surface of a photoreceptor drum is selectively exposed according to image information, and an electrostatic latent image is formed thereon. The electrostatic latent image is developed and a toner image is formed. More specifically, the electrostatic latent image is developed by toner which is supplied to the surface of the photoreceptor drum from a developing sleeve. The toner image is then transferred to a printing sheet to form an image. Subsequently, this unfixed toner image is fixed to the printing sheet.

The toner is stored in a container. The container is provided with the developing sleeve and a screw for stirring and transferring the toner. The container, the developing sleeve, and the screw are unitized as a developing unit. Since the toner is supplied from the developing sleeve to the photoreceptor drum where it is consumed, it is necessary to compensate for the reduction of the toner in the developing unit. Therefore, a toner replenishing mechanism for replenishing toner to the developing unit is provided. Such a toner replenishing mechanism is configured as follows. Toner stored in a toner replenishing container is transferred to a toner replenishing section while being stirred by the screw. The toner is discharged from a discharge port provided on the toner replenishing section. The toner is then replenished to the developing unit through an inlet port. The inlet port is provided on the developing unit.

Sliding shutters are provided to open and close the discharge port and the inlet port, respectively. When both shutters are moved to positions that open both of the discharge port and the inlet port, the toner is replenished to the developing unit. Immediately before the opening of the discharge port, one of the shutters is slid so as to open the discharge port in a state in which the inlet port is already opened during the mounting and demounting operation of the developing unit to the apparatus body. In this manner, the toner discharged from the discharge port is prevented from spilling without being received into the developing unit which would contaminate the interior of the apparatus. In the related art, there is an image forming apparatus including a slide plate that is urged in a direction to close a discharge port of a toner replenishing container and a slide plate urged in a direction to close an inlet port of the developing unit.

However, the apparatus in the related art is not configured to open the discharge port only when the inlet port is completely opened. Therefore, there is the possibility of contaminating the interior of the apparatus with toner when mounting and demounting the developing unit.

SUMMARY OF THE INVENTION

In order to overcome the problems described above, preferred embodiments of the present invention provide an image forming apparatus including a shutter which slides in accordance with mounting and demounting operations of a developing device to an apparatus body, wherein contamination of the interior of the apparatus with toner at the time of mounting and demounting thereof is reliably prevented.

The present invention relates to an image forming apparatus in which a developing device which receives replenishment of toner from a replenishing device is removably mounted to an apparatus body. The developing device includes an inlet port, a first shutter, and a first urging member. The replenishing device includes a discharge port, a second shutter, and a second urging member. The inlet port receives toner from the replenishing device. The first shutter slides to open and close the inlet port. The first urging member urges the first shutter in the direction of closing the inlet port. The discharge port discharges toner to the developing device. The second shutter slides to open and close the discharge port. The second urging member urges the second shutter in the direction to close the discharge port. The first shutter slides in a mounting direction in association with the mounting operation of the developing device to the apparatus body. An interlocking member causes the second shutter to slide in conjunction with the first shutter. In association with a separating movement of the developing device from the apparatus body, the second shutter slides in the separating direction. In conjunction with the second shutter, the interlocking member causes the first shutter to slide. The direction in which the first shutter opens the inlet port is opposite from the mounting direction. The direction in which the second shutter opens the discharge port is the same as the mounting direction. An urging force W20 of the first urging member, which is applied to the first shutter for closing the inlet port, is smaller than an urging force W30 of the second urging member which is applied to the second shutter for closing the discharge port.

According to preferred embodiments of the present invention, the first shutter slides relative to the developing device in the direction to open the inlet port before the second shutter slides in the direction to open the discharge port. Therefore, the discharge port is not opened before the inlet port is opened. Consequently, toner is reliably prevented from spilling from the discharge port and contaminating the interior of the apparatus. On the other hand, in the separating movement of the developing device from the apparatus body from a state in which the inlet port and the discharge port are closed, there is no possibility that the discharge port is opened before the inlet port is opened. Therefore, contamination of the interior of the apparatus by toner from the discharge port is reliably prevented.

In a preferred embodiment of the present invention, an urging force W21 of the first urging member applied to the first shutter that opens the inlet port in the direction to close the inlet port is smaller than the urging force W30 of the second urging member applied to the second shutter that closes the discharge port.

According to this preferred embodiment, the following operations are performed at the time of mounting the developing device to the apparatus body from the state in which the inlet port is opened and the discharge port is closed. In this state, the first shutter has slid in association with the movement of the developing device in the direction to mount the apparatus body. A force is applied to the second shutter to cause the second shutter to slide in the same direction as the first shutter to open the discharge port via the interlocking member. When this force exceeds an urging force that the second urging member applies to the second shutter for closing the discharge port, the second shutter slides in the direction to open the discharge port. Therefore, when the second shutter slides in the direction to open the discharge port, the inlet port is already opened by the first shutter. Therefore, the inlet port is never opened when the discharge port is opened. The toner discharged from the discharge port is stored in the developing device via the inlet port. Consequently, contamination of the interior of the apparatus by toner is reliably prevented. On the other hand, at the time of separating the developing device from the apparatus body from a state in which the inlet port is opened and the discharge port is closed, there is no possibility that the discharge port is opened before the inlet port is opened. Therefore, contamination of the interior of the apparatus by toner from the discharge port is reliably prevented.

In another preferred embodiment of the present invention, the urging force W21 of the first urging member applied to the first shutter that opens the inlet port in the direction to close the inlet port is smaller than an urging force W31 of the second urging member applied to the second shutter that opens the discharge port in the direction to close the discharge port.

According to this preferred embodiment, the following operations are performed at the time of separating the developing device from the apparatus body from a state in which the inlet port and the discharge port are opened. At this time, the first shutter is about to slide in association with the movement of the developing device in the direction to separate the developing device from the apparatus body. A force is applied to the second shutter via the interlocking member to cause the second shutter to slide in a direction away from the first shutter to open the discharge port. However, this force is smaller than the urging force of the second urging member applied to the second shutter for opening the discharge port in the direction to close the discharge port. Therefore, when the second shutter slides relative to the developing device in the direction to close the discharge port, the first shutter slides with the developing device with the inlet port opened. Therefore, the inlet port is never to be kept unopened when the discharge port is opened. The toner discharged from the discharge port is stored in the developing device via the inlet port. Therefore, contamination in the interior of the apparatus by the toner is reliably prevented. On the other hand, an urging force of the first urging member applied to the first shutter to slide in the direction to open the inlet port is smaller than the urging force of the second urging member applied to the first shutter via the interlocking member, which is a force in the opposite direction from the direction described above. Therefore, there is no possibility that the inlet port is opened with the discharge port opened. Therefore, contamination of the interior of the apparatus by toner is reliably prevented.

Other features, elements, processes, steps, characteristics, and advantages of the present invention will become more apparent from the following detailed description of preferred embodiments of the present invention with reference to the attached drawings.

DETAILED DESCRIPTION OF THE PREFERRED EMBODIMENTS

Figure 1:
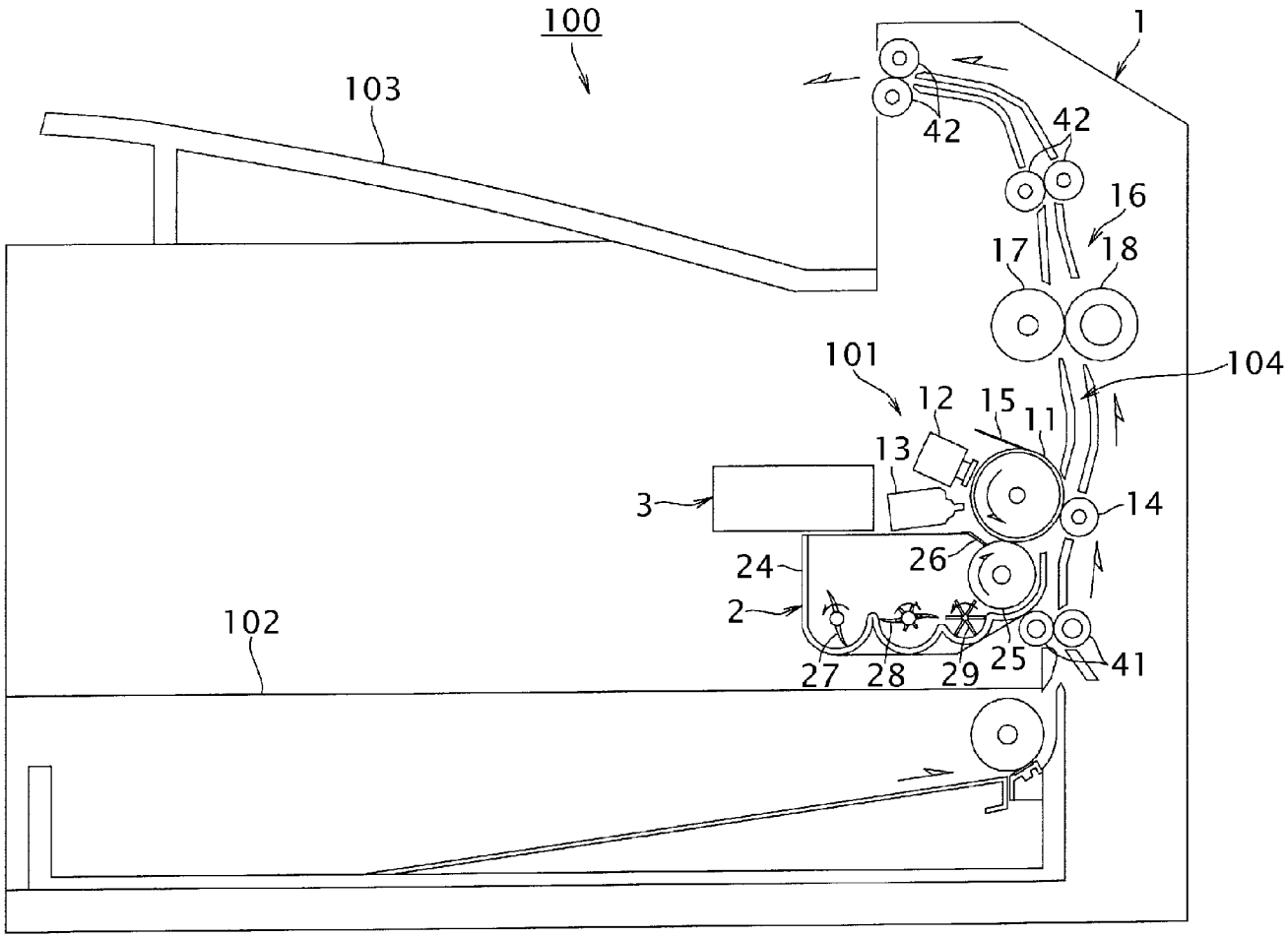
FIG. 1 shows an internal configuration of a copy/facsimile multi-function machine according to a preferred embodiment of the present invention.

FIG. 1 is a schematic cross-sectional view of an internal configuration of a copy/facsimile multi-function machine 100 having an image forming apparatus according to a preferred embodiment of the present invention. The multi-function machine 100 includes a machine body 1, a developing unit 2 mounted to the machine body 1 and a toner replenishing unit 3 for replenishing toner to the developing unit 2.

An image forming section 101 including the developing unit 2 and the toner replenishing unit 3 is arranged in the machine body 1. The machine body 1 further includes a paper feed cassette 102 provided on the bottom thereof for feeding a printing sheet in sequence, and a paper discharge tray 103 above the image forming section 101, respectively. Although not shown in the drawings, the copy/facsimile multi-function machine 100 preferably includes an image reading unit above the paper discharge tray 103 which functions as a flat bed scanner and an operating panel for inputting a start or the like of image reading or printing.

The paper feed cassette 102 may accommodate printing sheets of various sizes. The printing sheet stored therein is fed to a carrier path 104 one-by-one. The carrier path 104 is provided with a pair of resist rollers 41. The printing sheet is adjusted to the proper orientation and transported to the image forming section 101 by the pair of resist rollers 41. Carrier rollers 42 are provided in the carrier path 104 as needed. The printing sheet on which an image is formed by the image forming section 101 is transported by the carrier rollers 42, and is discharged into the paper discharge tray 103. In this manner, the printing sheet is transported from the paper feed cassette 102 along the carrier path 104 to the image forming section 101. Then, images, characters, and the like are printed on the printing sheet in the image forming section 101. After printing, the printing sheet is discharged onto the paper discharge tray 103.

The image forming section 101 includes a photoreceptor drum 11, a charging device 12, an LED head 13, the developing unit 2, the toner replenishing unit 3, a transfer roller 14, a cleaning blade 15, and a fixing device 16. The charging device 12, the LED head 13, the developing unit 2, the toner replenishing unit 3, the transfer roller 14, and the cleaning blade 15 are arranged around the photoreceptor drum 11. The fixing device 16 is arranged in the carrier path 104 on the downstream side of the photoreceptor drum 11.

The photoreceptor drum 11 is provided with a photoconductor film formed of an organic photoreceptor on the surface thereof. The photoreceptor drum 11 rotates at a predetermined velocity by a drive source, not shown. Then, the photoreceptor drum 11 is charged at a certain voltage by the charging device 12. The charging device 12 uses a non-contact corona electrical charging system, a so-called "scorotron charger". Although not shown in detail in the drawings, the charging device 12 includes a discharging wire arranged approximately at a center of a casing electrode, which defines a half-space, and a grid electrode on the side of the photoreceptor drum 11. Corona discharge occurs by applying a predetermined voltage on the discharging wire, and the amount of ions generated by the corona discharge is controlled by the grid electrode. The charging device 12 may be any other type of charging device which uses a contact-type roller charging system, or the like, instead of a non-contact corona electrical charging system.

The LED head 13 is preferably a so-called self-luminous printer head having an LED array including the same number of printing pixels for forming an image of light emitted by the LED array on the surface of the photoreceptor drum 11 by a SELFOC lens array (registered trademark). The LED head 13 selectively exposes the surface of the photoreceptor drum 11 on the basis of the image information to form an electrostatic latent image on the surface thereof. The surface of the photoreceptor drum 11 which is charged by the charging device 12 is attenuated in surface potential by being exposed to the LED head 13, so that an electrostatic latent image is formed by the potential difference between the exposed portions and the unexposed portions. The image information, for example, an image of an original document read by the image reading unit which functions as a flat-bed scanner, is transmitted to the LED head 13 in the form of an electrical signal. The exposing device may be a scanning optical system using a semiconductor laser instead of the LED head 13.

Figure 2A:
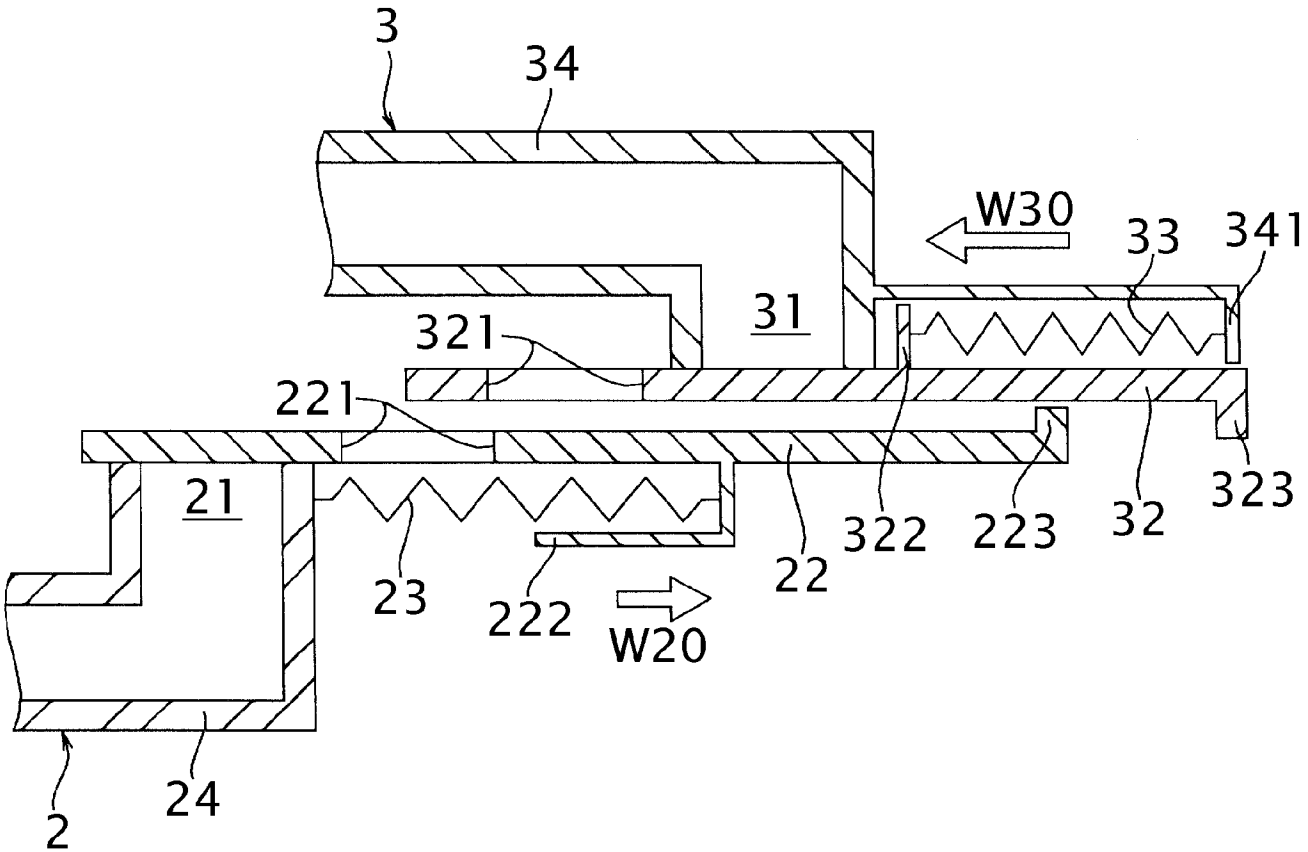
FIG. 2A illustrates a state before a developing unit and a toner replenishing unit come into abutment at the time of mounting and demounting of the developing unit.

The developing unit 2 is preferably a unitized developing member using a two-component toner including toner fine particles and a carrier. The developing unit 2 is removably mounted to the machine body 1 so as to be replaceable with a new one when the developing function has deteriorated. The developing unit 2 includes a toner receiving section as shown in FIG. 2A. The toner receiving section is provided with an inlet port 21, a first shutter 22, and a first coil spring 23 functioning as a first urging member. The inlet port receives toner replenished from the toner replenishing unit 3. The first shutter 22 slides to open and close the inlet port 21. The first coil spring 23 urges the first shutter 22 in the direction to close the inlet port 21. The first coil spring 23 is engaged with the first shutter 22 at one end thereof and is engaged with a toner receiving container 24 at the other end thereof. The toner receiving container 24 defines the outer appearance of the developing unit 2 and accommodates the received toner. The mounting and demounting operations of the developing unit 2 with respect to the machine body 1 are performed with respect to the mounting direction, which is the rightward direction in FIG. 2A, and the demounting direction, which is the leftward direction, that is, the opposite direction.

The toner replenishing unit 3 is preferably a unitized toner replenishing member which replenishes toner to the developing unit 2. The toner replenishing unit 3 is detachably attached to the machine body 1 so as to be replaceable with a new one when the toner replenishing function has deteriorated. The toner replenishing unit 3 includes a toner replenishing section. The toner replenishing section is provided with a discharge port 31, a second shutter 32, and a second coil spring 33 functioning as a second urging member. Toner replenished to the developing unit 2 is discharged from the discharge port 31. The second shutter 32 slides to open and close the discharge port 31. The second coil spring 33 urges the second shutter 32 in the direction to close the discharge port 31. The second coil spring 33 is engaged with the second shutter 32 at one end thereof, and is engaged with a toner replenishing container 34 at the other end thereof. The toner replenishing container 34 defines the outer appearance of the toner replenishing unit 3 and accommodates the replenished toner.

The transfer roller 14 is a roller preferably formed of EPDM foam as shown in FIG. 1. The transfer roller 14 is in pressing contact with the photoreceptor drum 11 at a position opposite the carrier path 104. The transfer roller 14 is applied with a bias voltage from an electric circuit, not shown. A printing sheet supplied from the paper feed cassette 102 via the carrier path 104 is nipped by the photoreceptor drum 11 and the transfer roller 14. During this movement, a bias voltage is applied to the transfer roller 14, and hence the toner image on the surface of the photoreceptor drum 11 is transferred to the printing sheet.

The cleaning blade 15 is brought into pressing contact with the photoreceptor drum 11 after the transfer of the toner to the printing sheet. A constant voltage is applied to the cleaning blade 15 from the electric circuit, not shown. Accordingly, toner or paper powder remaining on the surface of the photoreceptor drum 11 is removed, and the electrostatic latent image is erased. Consequently, the surface of the photoreceptor drum 11 is cleaned to enable continuous usage. In preferred embodiments of the present invention, a cleaning method using other contact systems or non-contact systems using a cleaning roller or the like instead of the cleaning blade can also be used. In preferred embodiments of the present invention, a system having no cleaning member is also applicable.

The fixing device 16 includes a heating roller 17 and a pressing roller 18. The heating roller 17 and the pressing roller 18 are arranged in the carrier path 104 at opposed positions. The fixing device 16 heats and presses the toner image on the printing sheet transported through the carrier path 104 to fix the same. The surface of the heating roller 17 is maintained at a predetermined temperature by a heater. The pressing roller 18 is in a pressing contact with the heating roller 17 at a predetermined pressure. The printing sheet on which the toner image is transferred is nipped between the heating roller 17 and the pressing roller 18 so that the toner on the printing sheet is melted and fixed. The image on the original document read by the image reading unit is formed on the printing sheet by the image forming section 101 configured as described above.

Subsequently, the configuration of the developing unit 2 will further be described. Two-component toner including toner and carrier is preferably used. The developing unit 2 includes a developing sleeve 25, the toner receiving container 24, a regulating blade 26, two screws 27, 28 (carrier augers), and a paddle 29. The developing sleeve 25 is arranged so as to oppose the photoreceptor drum 11. The toner receiving container 24 accommodates toner. Screws 27, 28 transfer the toner stored in the toner receiving container 24 while stirring the same. The toner stirred and transferred by the screws 27, 28 and paddle 29 is supplied to the developing sleeve 25, and the toner carried on the surface of the developing sleeve 25 is supplied to the photoreceptor drum 11. The electrostatic latent image on the surface of the photoreceptor drum 11 is developed by the toner. The toner image is thus formed.

The developing sleeve 25 is supported by the toner receiving container 24 so as to be capable of rotating at a position in the vicinity of the photoreceptor drum 11 in a state in which the developing unit 2 is mounted to a predetermined position in the machine body 1. The surface of the developing sleeve 25 is electrically charged by being applied with a bias voltage. Toner electrically charged by being stirred by the screws 27, 28 is supplied to the developing sleeve 25 and the toner is carried on the surface of the developing sleeve 25. The developing sleeve 25 rotates in synchronism with the axial rotation of the photoreceptor drum 11. The toner carried on the surface of the developing sleeve 25 is supplied to the photoreceptor drum 11 because of the potential difference between the surface of developing sleeve 25 and the electrostatic latent image on the photoreceptor drum 11. In this manner, the electrostatic latent image on the surface of the photoreceptor drum 11 is visualized, and the toner image is formed.

The regulating blade 26 is disposed on the toner receiving container 24 in the vicinity of the surface of the developing sleeve 25. The regulating blade 26 scrapes off excess toner carried on the surface of the developing sleeve 25 to regulate the thickness of the layer of toner.

Figure 3:
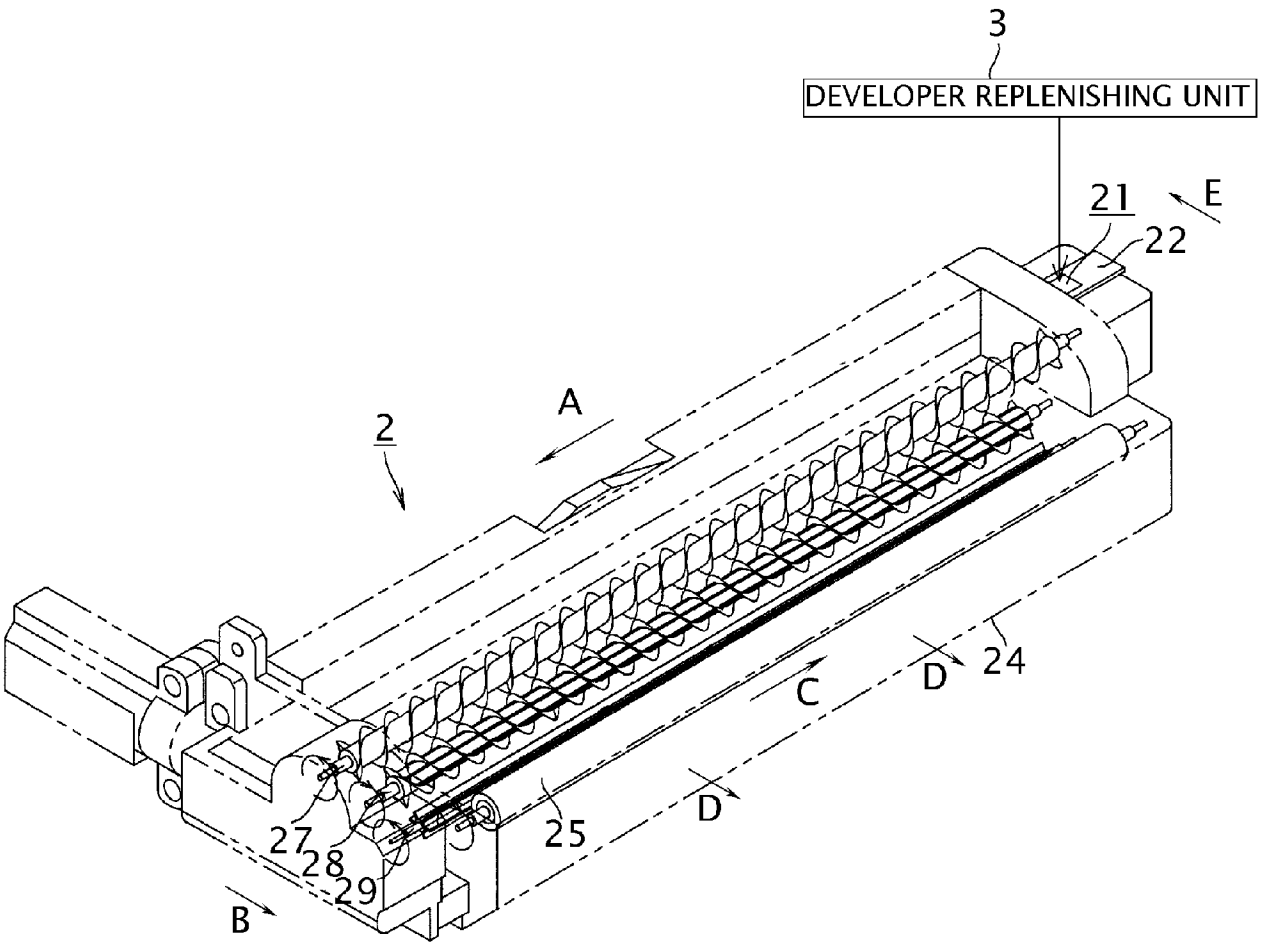
FIG. 3 shows an internal configuration of the developing unit.

As shown in FIG. 3, the two screws 27, 28 and the paddle 29 are supported respectively in the toner receiving container 24 so as to be capable of rotating at a position adjacent to the developing sleeve 25 in parallel to an axial line thereof. The screw 27 extends to the right far end in FIG. 3 and hence is longer than the screw 28. The right far end corresponds to the toner receiving section for receiving replenishment of toner from the toner replenishing unit 3. The screw 27 is preferably provided with a helical shaped thin blade. The screw 27 rotates in the direction indicated by an arrow (counterclockwise). The screw 27 transfers the toner replenished to the toner receiving section in the direction indicated by an arrow A while stirring the same. The screw 28 is preferably provided with a helical shaped thin blade and radial thin blades. The screw 28 rotates in the direction indicated by an arrow (clockwise). The screw 28 transfers the toner in the direction indicated by an arrow C while stirring the same and transfers a portion of the toner in the direction indicated by an arrow D and supplies the same toward the paddle 29. The paddle 29 is preferably provided with radial thin blades. The paddle 29 rotates in the direction indicated by an arrow (counterclockwise) The paddle 29 transfers the toner toward the developing sleeve 25 while stirring the same.

As shown in FIG. 1, a partitioning wall is provided on the bottom surface of the toner receiving container 24 between the screw 27 and the screw 28 along the axial direction thereof. Communication ports are formed respectively at both end portions of the partitioning wall in the longitudinal direction. A lower partitioning wall is provided on the bottom surface of the toner receiving container 24 between the screw 28 and the paddle 29 along the axial direction thereof.

The toner replenished from the toner receiving section by the toner replenishing unit 3 is transferred in the direction indicated by the arrow A while being stirred by the screw 27 as shown in FIG. 3. The toner transferred to the axially other end (the left near side in FIG. 3) by the screw 27 is transferred through the communication port in the direction indicated by an arrow B. The toner is further transferred in the direction indicated by the arrow C while being stirred by the screw 28. The toner transferred to the axially one end by the screw 28 is transferred through a communication port in the direction indicated by an arrow E. The toner is transferred again by the screw 27. In this manner, the toner is circulated and transferred by the two screws 27, 28 which transfer the toner in opposite directions and sufficiently stir the toner. The toner is electrically charged during this process.

The toner is transferred by the screw 28 in the direction indicated by the arrow C, and then a portion of the toner is supplied toward the paddle 29 as indicated by the arrow D beyond the lower partitioning wall. The toner supplied toward the paddle 29 is stirred by the paddle 29, and then is supplied to the developing sleeve 25 by being scooped and placed thereon. The toner supplied to the developing sleeve 25 is electrically charged by being stirred. The electrically charged toner is carried on the surface of the developing sleeve 25 which is electrically charged in the opposite potential.

Subsequently, a configuration of the toner receiving section of the developing unit 2 will be described. In the developing unit 2, one end (the right far side in FIG. 3) in the axial direction (longitudinal direction) of the screw 27 corresponds to the toner receiving section. As shown in FIG. 2A, in the toner receiving section, the inlet port 21 is provided on an upper wall which defines the upper surface of a housing of the toner receiving container 24. In the toner receiving section, the plate-shaped first shutter 22 which slides to open and close the inlet port 21 is arranged. The first shutter 22 is formed with an opening 221 which is wider than the inlet port 21. The first shutter 22 slides while projections (not shown) provided on a side portion thereof are guided in guide holes (not shown) provided on the upper wall of the toner receiving container 24 so as to extend in parallel to each other. In this manner, the first shutter 22 slides along the upper surface of the toner receiving container 24. The first shutter 22 is capable of sliding relative to the toner receiving container 24 within a predetermined section between an open position (a position where toner can be replenished), and a closed position (retracted position). In the open position, the opening 221 is positioned above the inlet port 21, and the inlet port 21 is completely opened. In the closed position (retracted position), the opening 221 is not positioned above the inlet port 21 and covers and closes (obstructs) the inlet port 21. Furthermore, the first shutter 22 is constantly urged in the direction to close the inlet port 21 (rightward in the drawing) by the first coil spring 23. One end of the first coil spring 23 is engaged with a coil spring engaging strip 222 that is preferably integral with the first shutter 22. The other end of the first coil spring 23 is engaged with the side wall of the toner receiving container 24. The first coil spring 23 resiliently applies an urging force in its expanding direction by being engaged in a state of being compressed from the free length thereof. The coil spring engaging strip 222 comes into abutment with the side wall of the toner receiving container 24, and hence functions as a stopper which constrains the relative sliding movement of the first shutter 22 with respect to the developing unit 2 in the leftward direction in the drawing. The constraint of the sliding movement of the first shutter 22 is performed also by the projections and the guide holes. The first shutter 22 is preferably integral with a projecting strip 223 which projects upward.

The toner replenishing unit 3 will be further described below. The toner replenishing unit 3 has substantially the same length as the developing unit 2. The toner replenishing unit 3 includes the toner replenishing container 34 and a screw (not shown). The toner replenishing container 34 accommodates toner. The screw transfers the toner from the toner receiving section (not shown) such as a toner cartridge to the toner replenishing section while stirring the toner. The toner replenishing unit 3 is mounted to a predetermined position of the machine body 1. In the mounted state, the toner replenishing section is positioned exactly above the toner receiving section of the developing unit 2.

When the toner replenishing unit 3 is mounted to the predetermined position of the machine body 1 (see FIG. 4B), the inlet port 21 of the developing unit 2 is positioned exactly below a lower wall which defines the lower surface of the housing of the toner replenishing container 34. The discharge port 31 is formed in the lower wall of the toner replenishing container 34. The plate-shaped second shutter 32 that slides to open and close the discharge port 31 is provided on the toner replenishing section. The second shutter 32 is formed with an opening 321 which is wider than the discharge port 31. The second shutter 32 slides along the lower surface of the toner replenishing container 34. More specifically, projections (not shown) are formed on the side portions of the second shutter 32. The second shutter 32 slides while being guided by projections (not shown) sliding in guide holes (not shown) formed on the lower wall of the toner replenishing container 34 so as to extend in parallel to each other. In this manner, the second shutter 32 is capable of sliding relative to the toner replenishing container 34 in a predetermined section between an open position (a position where toner can be replenished) and a closed position (retracted position). The open position is a position where the opening 321 is positioned below the discharge port 31 to open the discharge port 31 completely. The closed position is a position where the opening 321 is not positioned below the discharge port 31, but a position where the discharge port 31 is covered and closed (obstructed). In addition, the second shutter 32 is constantly urged in the direction to close the discharge port 31 (leftward in the drawing) by the second coil spring 33. One end of the second coil spring 33 is engaged with a coil spring engaging strip 322 preferably formed integrally with the second shutter 32. The other end of the second coil spring 33 is engaged with a coil spring engaging strip 341 preferably formed integrally on the side wall of the toner replenishing container 34. The second coil spring 33 resiliently applies an urging force in its expanding direction by being engaged in a state of being compressed from the free length thereof. The second shutter 32 is preferably integrally formed with a projecting strip 323 projecting downward. The projecting strip 223 of the first shutter 22 and the projecting strip 323 of the second shutter 32 define an interlocking mechanism. The interlocking mechanism causes the second shutter 32 to slide in conjunction (move together) with the first shutter 22 when the first shutter 22 slides in the developing unit 2 mounting direction (rightward in the drawing). Accordingly, the interlocking mechanism causes the first shutter 22 to slide in conjunction with the second shutter 32 when the second shutter 32 slides in the direction in which the developing unit 2 is removed (leftward in the drawing).

A process of mounting and demounting the developing unit 2 to and from the machine body 1 in the image forming apparatus 100 according to the present preferred embodiment will be described with respect to the drawings. Description will be made assuming that the toner replenishing unit 3 is already fixedly mounted to a predetermined position of the machine body 1. The developing unit 2 is mounted to the predetermined position of the machine body 1 while moving the same in parallel from the near side to the far side of the plane of FIG. 1. A guide member (not shown) is provided so as to enable parallel movement of the developing unit 2 with respect to the machine body 1 in a predetermined section. The developing unit 2 is mounted to the machine body 1 with the first shutter 22 positioned at the front as shown in FIG. 2A.

Before the mounting operation of the developing unit 2 in conjunction with the toner replenishing unit 3 is performed, as shown in FIG. 2A, the first coil spring 23 applies an urging force W20 to the toner receiving container 24 in the direction to move the first shutter 22 rightward. That is, the first coil spring 23 urges the fist shutter 22 in the direction to close the inlet port 21 by the urging force W20. In this manner, the first shutter 22 is locked so as not to be slid and open the inlet port 21 by an impact due to movement, contact, or the like, so that spilling of toner is prevented. On the other hand, the second coil spring 33 applies an urging force W30 in the direction to move the second shutter 32 leftward with respect to the toner replenishing container 34. That is, the second coil spring 33 urges the second shutter 32 in the direction to close the discharge port 31 by the urging force W30. Therefore, the second shutter 32 is locked so as not to be slid and open the discharge port 31 by an impact due to contact with the developing unit 2 or the like, so that spilling of toner is prevented.

Figure 2B:
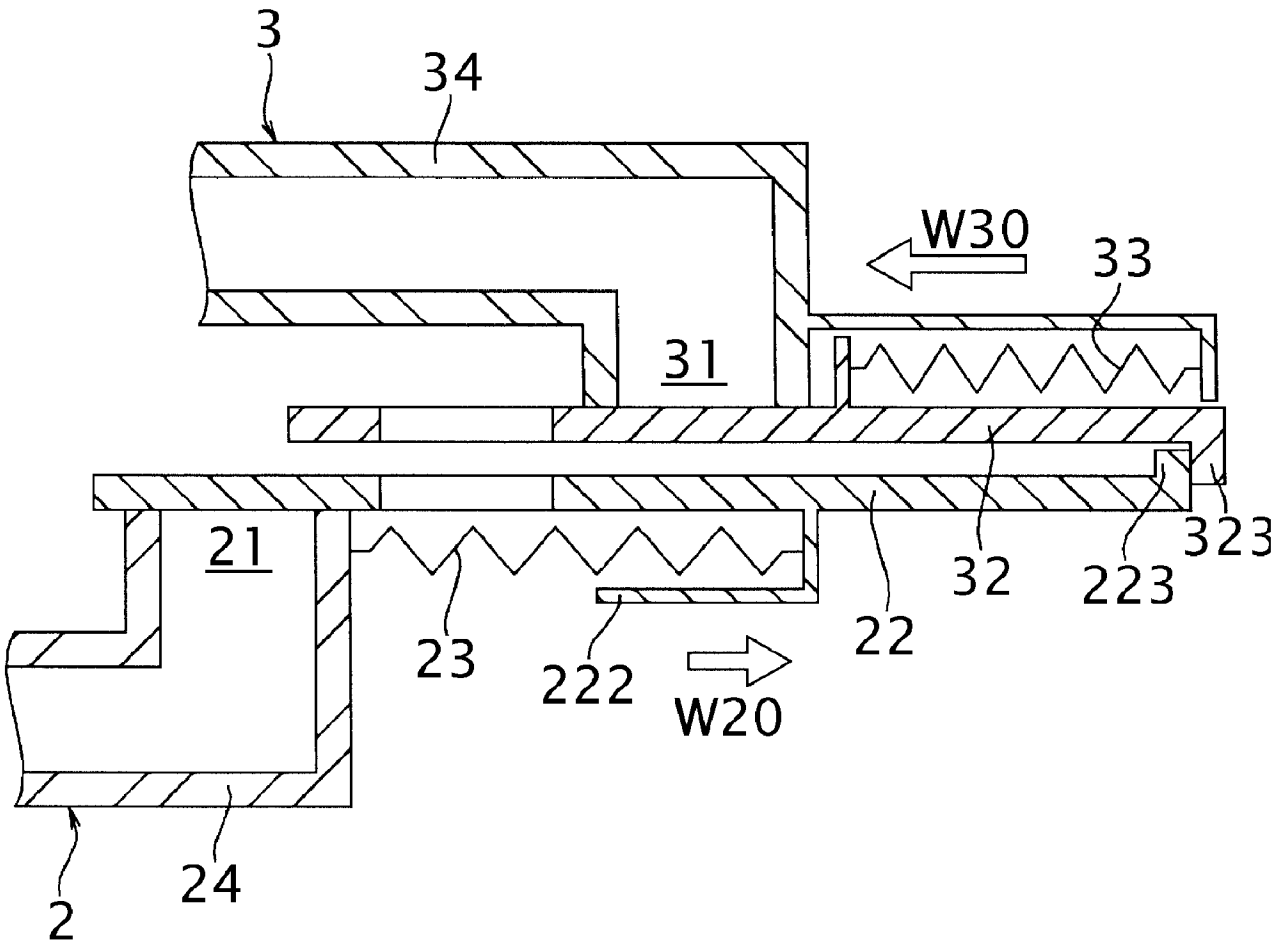
FIG. 2B illustrates a state in which the developing unit and the toner replenishing unit first come into abutment with each other.

When the developing unit 2 is further slid in parallel rightward in FIG. 2A, the projecting strip 223 formed on the first shutter 22 of the developing unit 2 abuts against the projecting strip 323 formed on the second shutter 32 of the toner replenishing unit 3 as shown in FIG. 2B.

Figure 4A:
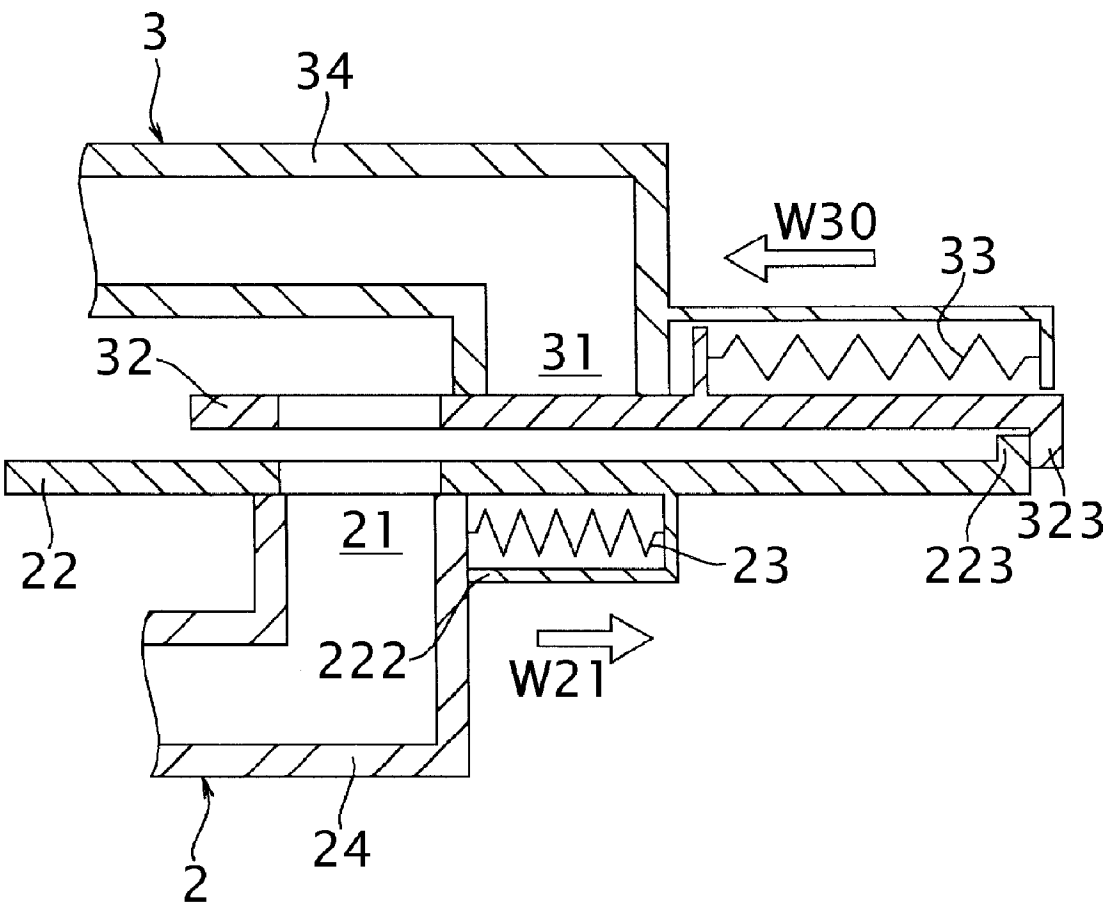
FIG. 4A illustrates a state in which the developing unit is further moved in the direction of mounting from the state shown in FIG. 2B during the mounting and demounting operation of the developing unit.

From this state, the developing unit 2 is further slid rightward in parallel with the toner replenishing unit 3, as shown in FIG. 2B. When the projecting strip 223 comes into abutment with the projecting strip 323, a force to cause the second shutter 32 to slide rightward is applied to the second shutter 32 via the first shutter 22. However, the urging force W30 which acts against the rightward sliding movement of the second shutter 32 is applied from the second coil spring 33. On the other hand, the urging force W20 which acts against a reaction force applied from the second shutter 32 to the first shutter 22 is applied from the first coil spring 23. The urging force W20 is smaller than the urging force W30. Therefore, the first shutter 22 moves leftward relative to the developing unit 2. In association with the relative sliding movement of the first shutter 22, the first coil spring 23 is gradually compressed. Consequently, the urging force increases gradually from W20, and reaches W21 as shown in FIG. 4A. The urging force W21 is still smaller than the urging force W30. Therefore, the sliding movement of the second shutter 32 of the toner replenishing unit 3 is not started until the first shutter 22 of the developing unit 2 is slid to the open position. Therefore, the first shutter 22 is engaged with the second shutter 32, and hence the state in which the rightward movement thereof is prevented is maintained, so that only the developing unit 2 moves rightward. In this manner, the first shutter 22 starts to open the inlet port 21 with the movement of the developing unit 2 in a state in which the first shutter 22 stays at its position relative to the second shutter 32. Then, the developing unit 2 slides in the section regulated by the coil spring engaging strip 222 and the guide holes (not shown), and hence the inlet port 21 which has been closed is completely opened as shown in FIG. 4A.

Figure 4B:
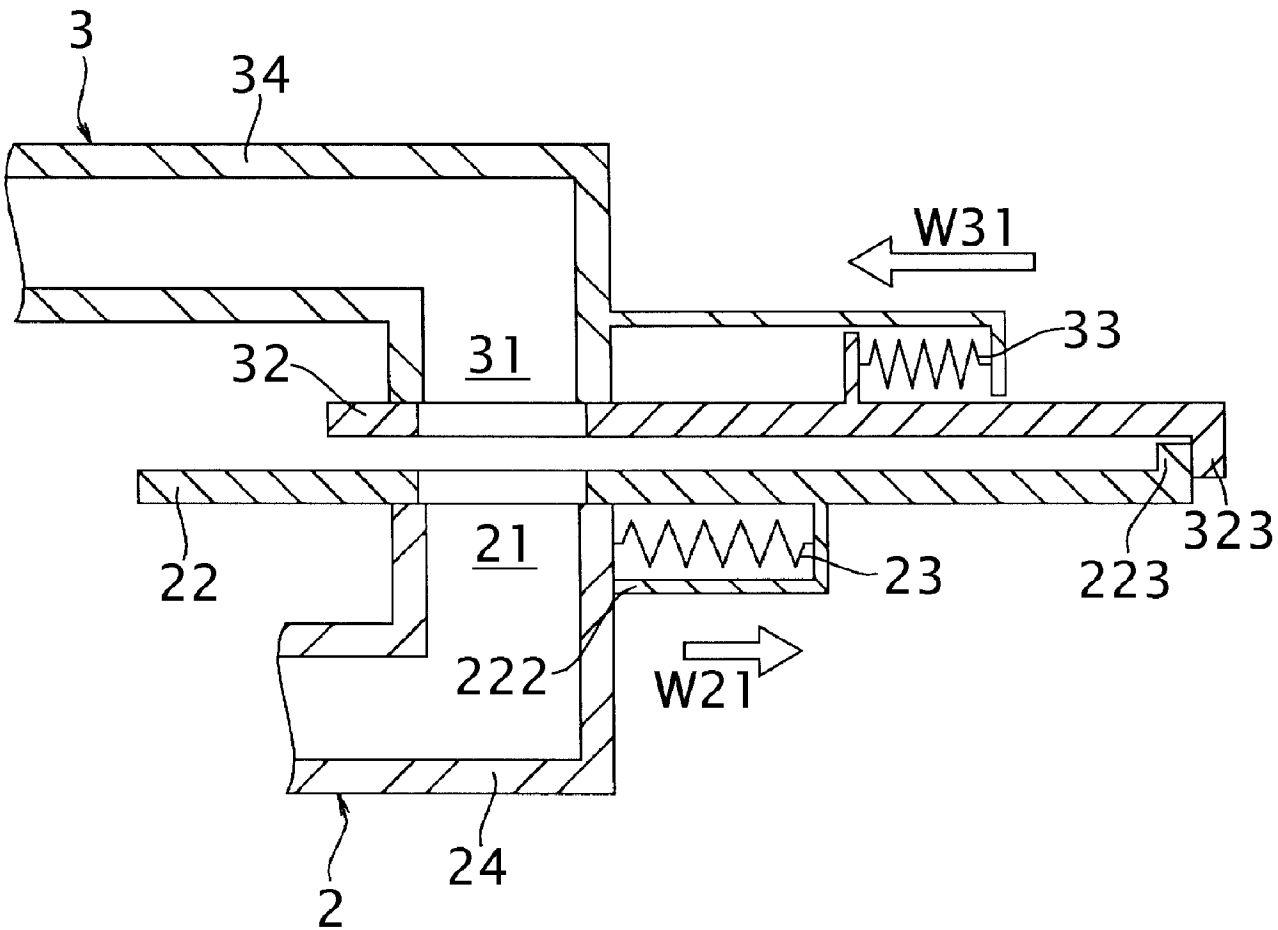
FIG. 4B illustrates a state in which the developing unit is mounted to a predetermined position in an apparatus body.

The developing unit 2 is further slid rightward in parallel from the state in FIG. 4A. When the movement load at this time exceeds the urging force W30 of the second coil spring 33 of the toner replenishing unit 3, the second shutter 32 whose projecting strip 323 abuts against the projecting strip 223 is slid rightward. The toner replenishing unit 3 is fixedly mounted to the machine body 1. The second shutter 32 moves relative to the toner replenishing container 34. Therefore, the second shutter 32 slides rightward in the mounting direction in association with the mounting operation of the developing unit 2 until the second shutter 32 of the toner replenishing unit 3 is moved to the open position. In association with the relative sliding movement of the second shutter 32, the second coil spring 33 is gradually compressed, whereby the urging force thereof gradually increases from W30, and then reaches W31 as shown in FIG. 4B. At this time, the second shutter 32 slides all the way through the section regulated by the guide holes (not shown), and is moved to the open position. In association with the rightward relative sliding movement of the second shutter 32 with respect to the toner replenishing unit 3, the discharge port 31 is gradually opened. Toner then drops from the opened discharge port 31. The opening 221 of the first shutter 22 and the inlet port 21 of the developing unit 2, which cooperate with the movement of the second shutter 32, are positioned exactly below the opening 321 formed in the second shutter 32. Therefore, the dropping toner is transferred to the developing unit 2 via the inlet port 21 without contaminating the interior of the apparatus.

The developing unit 2 is mounted to the predetermined position in the machine body 1 in the state shown in FIG. 4B, and is engaged with a member not shown. At this time, the discharge port 31 is completely opened. A state is achieved in which the discharge port 31 communicates with the inlet port 21 positioned immediately below the discharge port 31 and hence toner can be replenished from the toner replenishing unit 3 to the developing unit 2. The urging force W31 of the second coil spring 33 is applied in the direction to move the second shutter 32 leftward. The urging force W31 is larger than the urging force W21 of the first coil spring 23 acting in the direction to cause the first shutter 22 to slide rightward. Therefore, the state in which the inlet port 21 is closed by the difference of the urging forces is reliably maintained. Contamination in the apparatus by toner can also be prevented.

When demounting the developing unit 2 mounted at the predetermined position of the machine body 1, a process which proceeds reversely from the case of mounting the developing unit 2 is followed. Contamination in the apparatus by toner in the course of the demounting process is also reliably prevented.

As described above, with a simple configuration that the urging forces of the first and second coil springs 23, 33 satisfy a relationship: W31>W30>W21>W20, contamination by toner in association with mounting and demounting of the developing unit 2 is reliably prevented. Although the values of the respective urging forces may be determined as needed, it is preferable to consider that the reliability increases with an increase in the difference of the respective urging forces, that the first and second shutters 22, 32 do not slide by the impact or the like in association with the mounting and demounting operation, and that an operator him/herself must exert a force when mounting and demounting the developing unit 2.

The present invention is not limited to the preferred embodiments described above, and may be modified in various manners without departing from the scope of the present invention. For example, the example in which the expanding forces of the first and second coil springs 23, 33 are used as the urging force has been described, however the contracting force of the coil spring may be used as the urging force. It is also possible to use an urging member such as a torsion spring or a leaf spring instead of a coil spring. In addition, although the example in which the toner replenishing unit 3 transfers the toner stored therein to the toner replenishing section has been described, it may be replaced by a toner hopper or a device which collects the toner. Furthermore, a configuration in which the photoreceptor drum 11, the charging device 12, the developing unit 2, and the cleaning blade 15 are unitized as a process unit may also be applicable.

Although the preferred embodiments of the present invention have been described with respect to a copy/facsimile multi-function machine 100 preferably defining the image forming apparatus, the image forming apparatus is not limited to the copy/facsimile multi-function machine 100. Other embodiments may be used without departing from the scope of the present invention, such as an independent machine or a printer.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. An image forming apparatus comprising:

an apparatus body including a replenishing device arranged to replenish toner; and a developing device removably mounted to the apparatus body and arranged to receive toner from the replenishing device; wherein the developing device includes an inlet port arranged to receive the toner from the replenishing device, a first shutter that slides to open and close the inlet port, and a first urging member arranged to urge the first shutter in a direction to close the inlet port;

the replenishing device includes a discharge port arranged to discharge the toner to the developing device, a second shutter that slides to open and close the discharge port, and a second urging member arranged to urge the second shutter in a direction to close the discharge port;

an interlocking mechanism is arranged to cause the second shutter to slide in conjunction with the first shutter when the first shutter slides in a mounting direction in association with a mounting operation of the developing device to the apparatus body, and to cause the first shutter to slide in conjunction with the second shutter when the second shutter slides in a separating direction, which is an opposite direction from the mounting direction, in association with a separating operation of the developing device from the apparatus body;

the direction in which the second shutter opens the discharge port is the same direction as the mounting direction; and a first urging force that the first urging member applies to the first shutter which closes the inlet port is smaller than a second urging force that the second urging member applies to the second shutter which closes the discharge port.

2. The image forming apparatus according to claim 1, wherein a third urging force of the first urging member to be applied to the first shutter which opens the inlet port is smaller than the second urging force of the second urging member to be applied to the second shutter which closes the discharge port.

3. The image forming apparatus according to claim 2, wherein the third urging force of the first urging member applied to the first shutter which opens the inlet port is smaller than a fourth urging force of the second urging member applied to the second shutter which opens the discharge port.

4. The image forming apparatus according to claim 1, wherein a third urging force of the first urging member applied to the first shutter which opens the inlet port is smaller than a fourth urging force of the second urging member applied to the second shutter which opens the discharge port.

5. The image forming apparatus according to claim 1, wherein the interlocking mechanism includes an upward facing first projecting strip provided on the first shutter, and a downward facing second projecting strip provided on the second shutter, and the first projecting strip and the second projecting strip come into abutment with each other at the time of the mounting operation or the separating operation of the developing device.

* * * * *